US006109960A

United States Patent [19]

Cooper et al.

[11] Patent Number: 6,109,960

[45] Date of Patent: Aug. 29, 2000

[54] CONNECTOR TOWER

[75] Inventors: Ralph Melvin Cooper, Clemmons; Donald Gray Stillie, Winston-Salem, both of N.C.

[73] Assignee: The Whitaker Corporation, Wilmington, Del.

[21] Appl. No.: 08/909,123

[22] Filed: Aug. 11, 1997

Related U.S. Application Data

[60] Provisional application No. 60/024,925, Aug. 30, 1997.

[51] Int. Cl.[7] ..... H01R 13/73

[52] U.S. Cl. ..... 439/546; 439/557

[58] Field of Search ..... 439/546, 545, 439/548, 557, 552, 271, 76.1, 947, 332, 335, 337

[56] References Cited

U.S. PATENT DOCUMENTS

| | | | |
|---|---|---|---|
| 3,824,524 | 7/1974 | Glover | 439/557 |
| 4,758,181 | 7/1988 | Reedy | 439/546 |
| 5,382,174 | 1/1995 | Kinohita | 439/271 |
| 5,727,421 | 3/1998 | Murphy | 439/271 |
| 5,800,210 | 9/1998 | Sparks, Jr. et al. | 439/573 |

*Primary Examiner*—Michael L. Gellner
*Assistant Examiner*—Antoine Nganajui

[57] ABSTRACT

The invention comprises a connector tower assembly having a housing with insert molded contacts therein. The housing has one end with a groove for receiving a seal therealong. The housing has a central portion with a sealing surface extending therearound. A second end of the housing has latching members for engaging and securing the housing to a connector box.

9 Claims, 3 Drawing Sheets

CONNECTOR TOWER

This application claims the benefit of U.S. Provisional Application No. 60/024,925, filed Aug. 30, 1997.

FIELD OF THE INVENTION

The present invention relates to an electrical component for transmitting electrical power.

BACKGROUND OF THE INVENTION

Electrical/electronic component housings manufactured for use in the automotive industry are subjected to particularly harsh conditions including vibration, temperature-cycling, and shock. Electrical/electronic component housings used in such conditions, therefore, must meet rigorous design requirements of the automotive industry, particularly where the housing is designed to protect electrical circuitry for automotive operating equipment. Automotive electrical components which are designed for use with such equipment generally should: comprise a structurally robust and sealed body; be designed to most efficiently perform their electrical function, e.g. by maximization of power transmission to the equipment; and should be manufactured at the lowest achievable cost of production.

Injection-mold technology, which has the advantage of low production costs, is typically used in limited sectors of the electrical connector industry at large to provide an insulating shroud around a respective electrical contact system. However, such conventional molded contact shrouds do not always meet the rigorous design requirements of the automotive industry.

A typical molded contact system is disclosed in U.S. Pat. No. 4,183,708, which comprises a plastic plug body with electrical contacts molded therein. The outer surfaces of the plug body are shaped for the basic purpose of gripping of the plug by an operator. Additionally, the geometrical configurations of the electrical contacts, and their locations in the plug, are adapted for use with a conventional plug-and-socket type connection. In sum, the plug body is not particularly structurally robust, and it is not designed to comprise a sealing interface; moreover, the contacts are not designed to maximize power transmission. Thus the plug of the prior art is designed for the less rigorous demands of residential use, rather than for use in the automotive industry where rigorous design requirements are the norm.

SUMMARY OF THE INVENTION

The invention comprises a connector tower assembly having a housing with in-molded contacts therein. The housing has one end with a groove for receiving a seal therealong. The housing has a central portion with a sealing surface extending therearound. A second end of the housing has latching members for engaging and securing the housing to a connector box.

The invention further comprises a connector tower assembly for insertion into a locking collar. The locking collar has recesses extending therealong. The recesses have a straight section and a ramped section. The ramped section extends along the bottom of the locking collar. The recesses have a locking detent at the end of the ramped section. The assembly has a housing with contacts in-molded therein. The housing has a sealing surface and locking lugs. The locking lugs are received within the recesses during insertion of the housing into the locking collar. The housing is rotated 45° about a central axis to lock the housing in position within the locking collar.

The invention further comprises a connector tower assembly for insertion into a locking collar. The locking collar has locking lugs. The assembly has a housing with contacts in-molded therein. The housing has a sealing surface and recesses. The recesses have a straight section and a ramped section. The ramped section extends along the bottom of the locking collar. The recesses have a locking detent at the end of the ramped section. The locking lugs are received within the recesses during insertion of the housing into the locking collar. The housing is rotated about a central axis to lock the housing in position within the locking collar.

BRIEF DESCRIPTION OF THE DRAWINGS

Embodiments of the invention will now be described with reference to the accompanying drawings, in which.

DETAILED DESCRIPTION OF THE INVENTION

Figure 1:
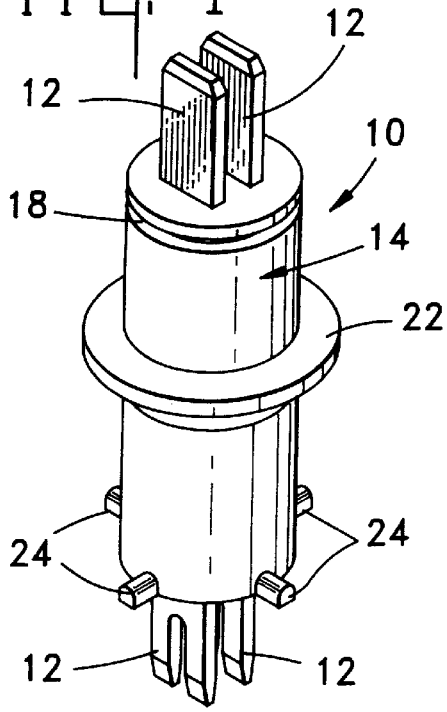
FIG. 1 is a perspective view of a connector tower of the present invention.

FIG. 1 shows one embodiment of the connector tower of the present invention. The connector tower provides electrical connection between two electrical devices, such as an electronic control module and a hydraulic pump motor. The connector tower is typically mounted in a connector box which would house the electronic control unit. The connector tower provides electrical connection between a printed wiring board on one side of the connector box and the pump motor which is mounted on the other side of the connector box. A seal must be maintained both against the connector box and the pump motor. The connector tower is mounted into a connector box, such as shown in U.S. Pat. No. 5,800,210. Only the details of the connector box that are necessary for the present invention will be illustrated herein.

The first embodiment of the connector tower assembly 10 has a pair of contacts 12 in-molded within housing 14. The contacts have connection sections which extend from either end of the housing 14. Along one end of the housing 14, a groove 18 is formed to receive an O-ring 20, see FIG. 2, to provide a seal against the harsh environment outside of the connector box 8. In the mid section of the housing 14 there is a sealing flange 22 which extends completely around the periphery of the housing 14. Along the other end of the housing are a series of four locking lugs 24 disposed about the periphery of the housing 14.

The connector tower 10 is received within a locking collar 26 of the connector box 8. The locking collar 26 has a circular opening 28 for receiving the connector tower 10 therein. The circular opening 28 has a series of four recesses 30 for receiving the locking lugs 24 therein. Each of the recesses 30 extend along the inner side of the circular opening and along the bottom of the circular opening, the recess 30 makes a right turn and extends along the bottom of the locking collar 26. The recess has a downwardly ramped cam portion 32 and a locking recess 34.

The specific embodiment is shown having a series of four locking lugs and locking recesses, however, the present invention could utilize a different number of locking lugs and recesses, such as a series of two or three locking lugs with the same number of locking recesses.

Figure 4:
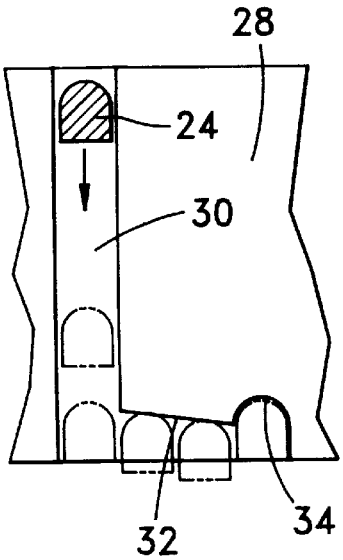
FIG. 4 is a view of the inner side of the locking collar.

When the connector tower 10 is inserted, and keyed, in the locking collar 26, the locking lugs 24 are received in the recesses 30. When the locking lugs 24 reach the bottom of the recess 30, the connector tower 10 is rotated 45°. The locking lug 24 will then be pushed along the ramped portion 32 of the recess until the locking lug snaps into the locking recess 34, as shown in FIG. 4. The connector tower 10 is locked into place and is prevented from rotating within the locking collar 26.

Figure 2:
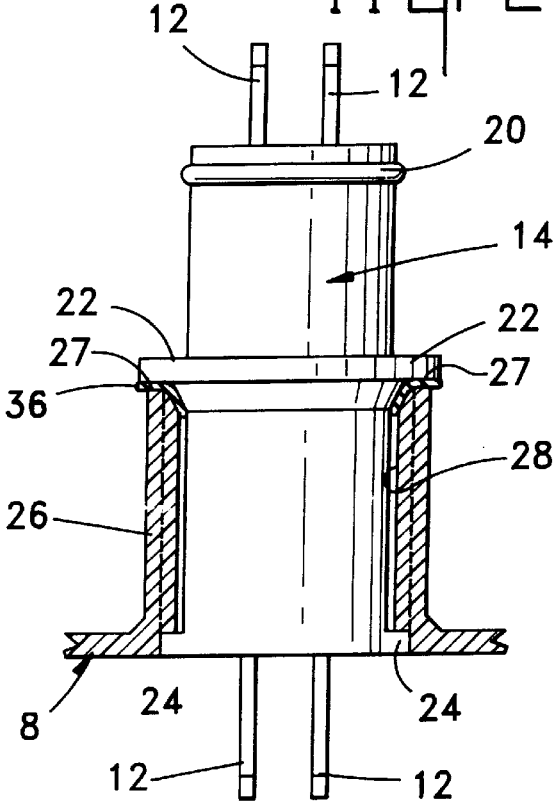
FIG. 2 is a side view of the connector tower showing a cross sectional view of the connector box.
Figure 3:
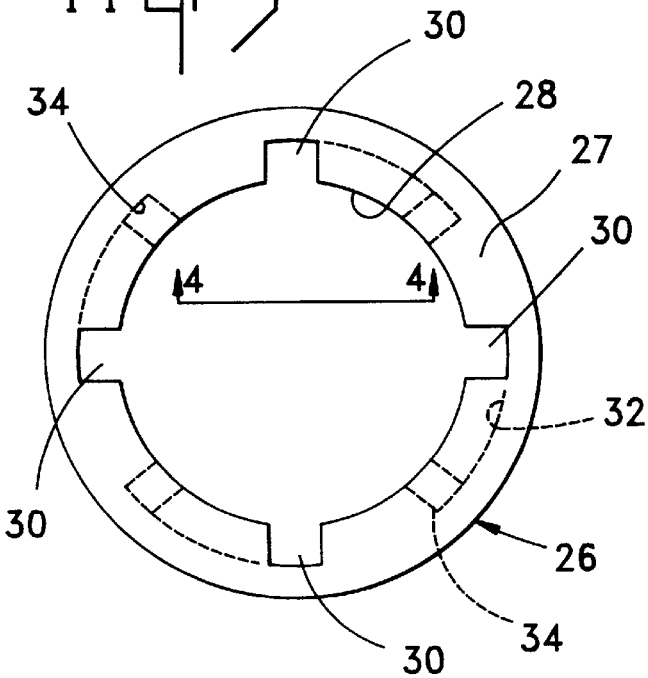
FIG. 3 is a top view of the connector box.

When the connector tower 10 is inserted in the locking collar 26, the flange seal 22 is pressed against the top of the locking collar 26 and depresses a seal 36 against the top sealing surface 27 of the locking collar, see FIG. 2. The pressure asserted against the sealing surface 27 on the locking collar 26 serves to seal the inside of the connector box 8 from the harsh environment outside the box 8. The connector tower thereby provides a seal, through flange seal 22, against entry of contaminants from the bottom of the connector tower assembly and the O-ring 20 provides a seal along the top of the connector tower assembly, against the mating connector or component such as a pump motor, not shown.

Figure 5:
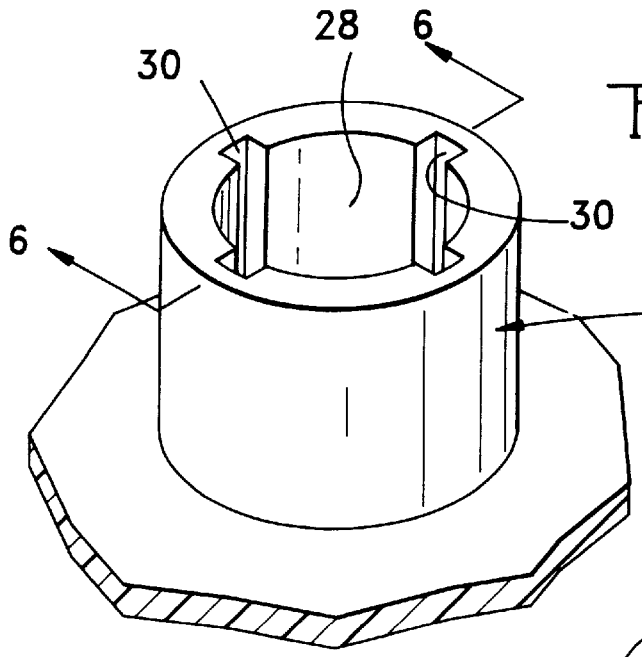
FIG. 5 is a perspective view of the locking collar.
Figure 6:
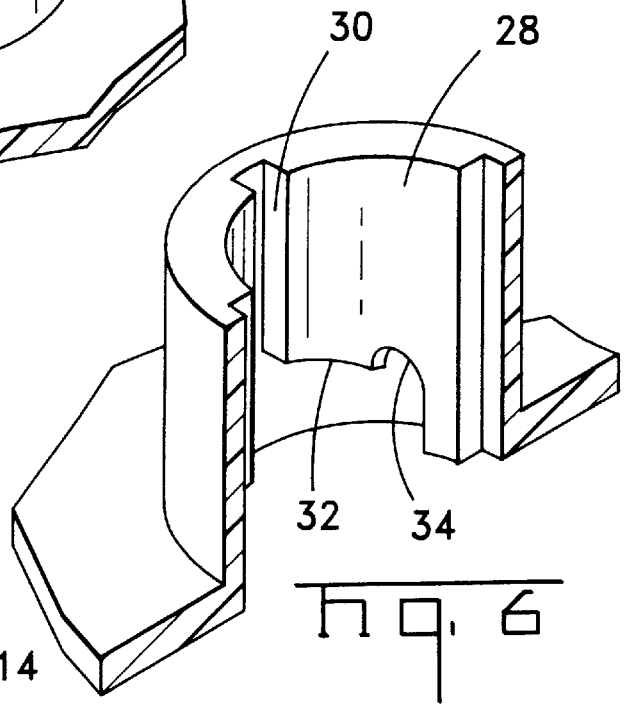
FIG. 6 is a cross sectional view of the locking collar taken along the line 6—6 in FIG. 5.

FIGS. 5 and 6 show the locking collar 26. FIG. 6 shows the recess 30 received along the inner side of the circular opening 28, extending along the length of the locking collar. The ramped portion 32 of the recess extends along the bottom of the locking collar 26 at a cam angle relative to the main portion of the recess 30. The connector tower 10 is received within the circular opening 28 with the locking lugs 24 aligned with the recesses 30. When the locking lugs 24 reach the bottom of the recesses 30, the tower 10 is rotated until the locking lug 24 is received within the locking recess 34. The tower 10 will spring upwardly when the locking lugs 24 are received within the locking recesses 34. The force from the seal 36 pushing the tower 10 upwardly will keep the locking lugs 24 secure within the locking recesses 34 and keep the tower from rotating back to its initial position.

Figure 7:
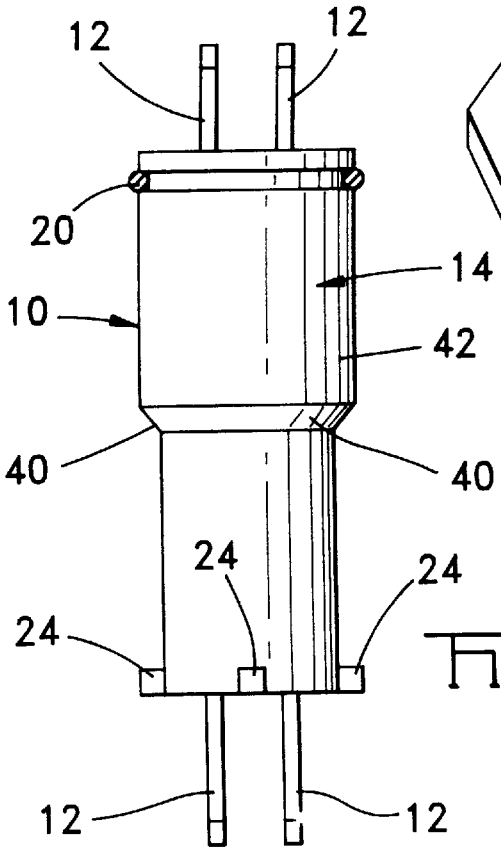
FIG. 7 is an alternative embodiment of the tower connector of the present invention.

FIG. 7 shows an alternative embodiment of the connector tower 10, in which like features will have like reference numerals. The tower 10 has contacts 12, an O-ring 20 for sealing, and locking lugs 24 for being received within the recesses 30 in the locking collar. The central portion of the tower 10 has a locking edge 40 which is in a comparable position as the sealing flange 22. The top portion 42 of the tower is wider than the lower portion of the tower to provide an uninterrupted transition between the sealing edge. When mounted in the locking collar, the sealing edge 40 will provide the same sealing function as the sealing flange 22.

Figure 8:
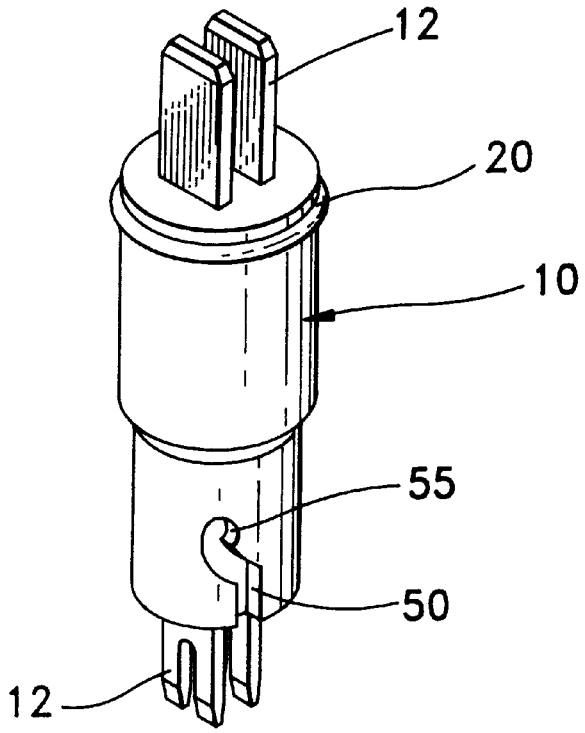
FIG. 8 is a connector tower having an alternative embodiment of the locking feature.
Figure 9:
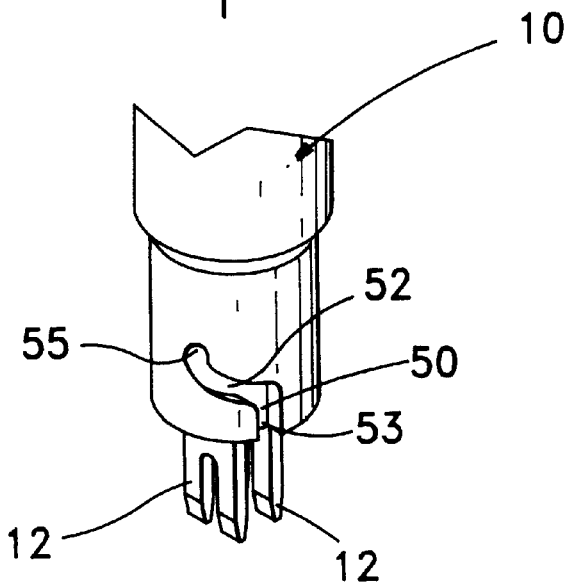
FIG. 9 shows another alternative embodiment for the locking feature.

FIGS. 8 and 9 show another embodiment in which the connector tower can be secured to the locking tower. The tower 10 shown in FIG. 8 has contacts 12, seal 20, and sealing flange or edge, not shown, as was shown in the earlier embodiments. The locking tower 10 has cam grooves 50 extending upwardly from the bottom of the tower. The cam grooves 50 are designed to receive locking lugs which are along the inner side of the locking collar 26. When the tower 10 is inserted into the locking collar 26, the locking lugs would be received within the cam grooves and guide the tower 10 into the proper position by rotating the tower, and lock the tower in place once that position is reached. FIG. 9 shows an alternative arrangement for the cam groove 50, where one portion of the groove 52 extends at substantially right angles with the entry portion 53. Both of the cam grooves 50 shown in FIGS. 8 and 9 having locking recesses 55 to lock the tower 10 in the proper position within the locking collar 26.

The advantages of the embodiments of the embodiments of the present invention are that the modular connector tower is straight draw molding and is not complicated. This invention eliminates insert molding the tower into the connector box as well as the associated sealing problems. The tower is simple to load into the connector box and latch in position. The tower assembly is insert molded off line from the connector box molding.

The advantages of the embodiments of the present invention are that the connector tower assembly will provide sealing against both the top electrical connection, not shown, and along the bottom of the connector tower assembly against the connector box.

The electrical connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

The connector tower of the present invention and many of its attendant advantages will be understood from the foregoing description. It is apparent that various changes may be made in the form, construction, and arrangement of parts thereof without departing from the spirit and scope of the invention, or sacrificing all of its material advantages.

What is claimed is:

1. A connector tower assembly, comprising:

a housing having one end with a groove for receiving a seal therearound, a central portion distanced from the groove and having a sealing flange extending therearound, a second end having latching members for engaging and securing the housing to a connector box, and a second seal compressed between the flange and the housing by engagement of the latching members to the connector.

2. The connector tower assembly of claim 1, wherein each of the contacts have connection sections, the connection sections extending outwardly from the housing to provide electrical connection with a printed wiring board.

3. The connector tower assembly of claim 1 wherein the latching members are lugs disposed about the connector housing, the connector box having recesses to receive the lugs therein.

4. The connector tower assembly of claim 3, wherein the recesses extend along a locking collar, the recesses having a ramped portion and a locking detent for securing the housing in the correct position within the locking collar.

5. The connector tower assembly of claim 4, wherein the housing is rotated from an insertion position to a locking position within the locking collar.

6. The connector tower assembly of claim 1, wherein the latching members are recesses to receive locking lugs on a locking collar, the recesses having a locking detent to secure the housing in the proper inserted position.

7. The connector tower assembly of claim 6, wherein the housing is rotated from an insertion position to a locking position within the locking collar.

8. A connector tower assembly for insertion into a locking collar, the locking collar having recesses extending therealong, the recesses having a straight section and a ramped section, the ramped section extending along the bottom of the locking collar, the recesses having a locking detent at the end of the ramped section, the assembly having a housing with contacts in-molded therein, the housing having a sealing flange and locking lugs, the locking lugs being received within the recesses during insertion of the housing into the locking collar, the housing being rotatable about a central axis to lock the housing in position within the locking collar, the assembly including a seal compressed between the flange and the locking collar by engagement of the locking lugs with the recesses.

9. A connector tower assembly for insertion into a locking collar, the locking collar having locking lugs, the assembly hating a housing with contacts in-molded therein, the housing having a sealing surface and recesses, the recesses having a straight section and a ramped section, the ramped section extending along the bottom of the locking collar, the recesses having a locking detent at the end of the ramped section, the locking lugs being received within the recesses during insertion of the housing into the locking collar, the housing being rotatable about a central axis to lock the housing in position within the locking collar, the assembly including a seal compressed between the flange and the locking collar by engagement of the locking lugs with the recesses.

* * * * *